US010783860B2

(12) United States Patent
Ham

(10) Patent No.: US 10,783,860 B2
(45) Date of Patent: Sep. 22, 2020

(54) DRUM WAH

(71) Applicant: Lawrence Jin-Sung Ham, Anna, TX (US)

(72) Inventor: Lawrence Jin-Sung Ham, Anna, TX (US)

( * ) Notice: Subject to any disclaimer, the term of this patent is extended or adjusted under 35 U.S.C. 154(b) by 0 days.

(21) Appl. No.: 15/237,483

(22) Filed: Aug. 15, 2016

(65) Prior Publication Data

US 2019/0311700 A1 Oct. 10, 2019

(51) Int. Cl.
*G10D 13/02* (2020.01)
*G10D 13/10* (2020.01)
*G10D 13/20* (2020.01)

(52) U.S. Cl.
CPC ..... *G10D 13/02* (2013.01); *G10D 13/10* (2020.02); *G10D 13/20* (2020.02)

(58) Field of Classification Search
CPC .... G10D 13/021; G10D 13/027; G10D 13/02; G10D 13/10; G10D 13/20
See application file for complete search history.

(56) References Cited

U.S. PATENT DOCUMENTS 1,845,625 A * 2/1932 Robison ..... G10D 13/04 84/419
2,495,450 A * 1/1950 Gladstone ..... G10D 13/10 84/411 R
2,495,451 A * 1/1950 Gladstone ..... G10D 13/021 84/411 R
2,568,504 A * 9/1951 Ludwig ..... G10D 13/04 84/419
3,185,013 A * 5/1965 Gussak ..... G10D 13/16 84/411 R
3,215,021 A * 11/1965 Kester, Jr. ..... G10D 13/021 84/411 R
3,685,389 A * 8/1972 Bemben ..... G10D 13/023 84/411 R
3,861,265 A * 1/1975 Van der Wyk ..... G10D 13/021 84/411 R
4,228,721 A * 10/1980 Hancox ..... G10D 13/023 84/411 A
4,377,964 A * 3/1983 Glassford, Jr. ..... G10D 13/021 84/411 R
5,610,350 A * 3/1997 Miller ..... G10D 13/023 84/413
7,488,882 B2 * 2/2009 Curet Troche ..... G10D 13/02 84/411 R
7,799,981 B1 * 9/2010 Curet Troche ..... G10D 13/026 84/411 R
7,888,568 B2 * 2/2011 Kashioka ..... G10D 13/04 84/41
2016/0335992 A1 * 11/2016 Ham ..... G10D 13/021
2019/0311700 A1 * 10/2019 Ham ..... G10D 13/16

* cited by examiner

*Primary Examiner* — Robert W Horn

(57) ABSTRACT

A drum and pitch adjustment device for a drum includes a drum with a sound producing membrane, a device for applying pressure to the sound producing membrane, and a cable configured to the device for applying and releasing pressure to the sound producing membrane, changing the pitch of the drum, but goes back to the drum's original pitch when absent this force. A hand operated lever, located on the side of the drum, operates the cable which makes the pressure device push up against the sound producing membrane and changing it's pitch. Absent this force, the drum goes back to its original pitch, which creates different tonal variety when played in real-time.

10 Claims, 3 Drawing Sheets

DRUM WAH

CROSS-REFERENCE TO RELATED APPLICATION

The present application is continuation in part of application Ser. No. 14/708,418, filed May 11, 2015, and invented by Lawrence Jin-Sun Ham.

FIELD OF THE INVENTION

The present invention is directed to a drum (percussion instrument) that bends the pitch.

BACKGROUND OF THE INVENTION

Percussion drums are usually tuned so that have a single pitch. The pitch of the drum is changed by tightening and loosening the head of the drum.

SUMMARY OF THE INVENTION

In one embodiment, the present invention, a drum wah lever (that is hand operated) that changes the tone of the sound off of the drum head (percussion instrument) during real-time playing.

DETAILED DESCRIPTION OF THE INVENTION

Figure 1:
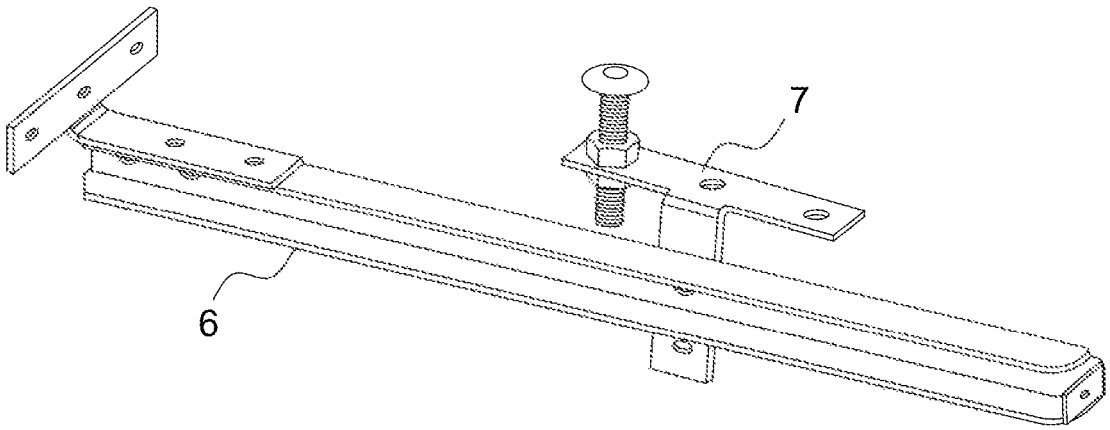
FIG. 1 illustrates the device for applying pressure to the sound producing membrane.
Figure 2:
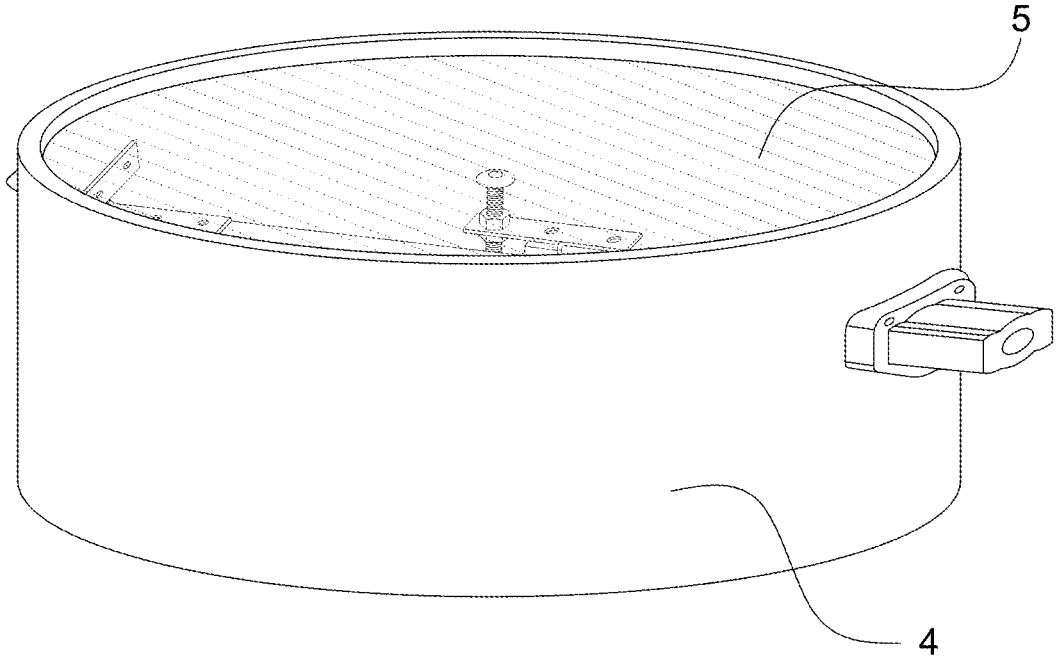
FIG. 2 illustrates the device when it is placed within the drum for operation.
Figure 3:
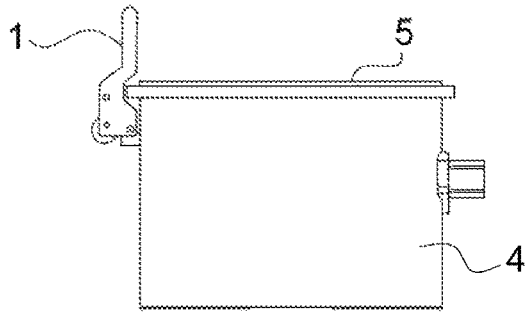
FIG. 3 through FIG. 9 illustrate, in further detail, the device inside the drum; as well as the lever and the cable (which is connected from the outside to the lever, and runs into the drum), included in the device.

A device for adjusting the tone and pitch drum, uses a pressure device (7) adapted to engage the sound producing membrane (5) of a drum (4) and is operated by a tension mechanism (3). The tension mechanism may be operably engaged by a cable (2) to provide pressure to the sound producing membrane of a drum. The cable may be of the form of a string (or a wire which is attached to a lever (1) from the outside and runs through the drum and attached to the pressure device (7), which is represented as a hinged post that will be inside the drum), to provide movement of the device applying pressure to the sound producing membrane of a drum. The cable may be moved by the musician manually or with the aid of a hand operated lever (1) while the drummer is playing. When absent of this force the drum goes back to it's original pitch.

The movement of the wire or string (which is connected to the lever, from the outside), applies and releases pressure on the sound producing membrane of a drum to provide a method of continuously varying the tone and pitch during play. The pressure device (7) shall be inside of the drum shell and operably moved by a cable and/or lever that extends outside, and on the side of the drum shell. As pressure is applied to the sound producing membrane the pitch increases. As pressure is withdrawn from the sound producing membrane the pitch decreases. The pitch may be varied by quickly applying and releasing pressure to the drum, while the drummer is playing.

Figure 4:
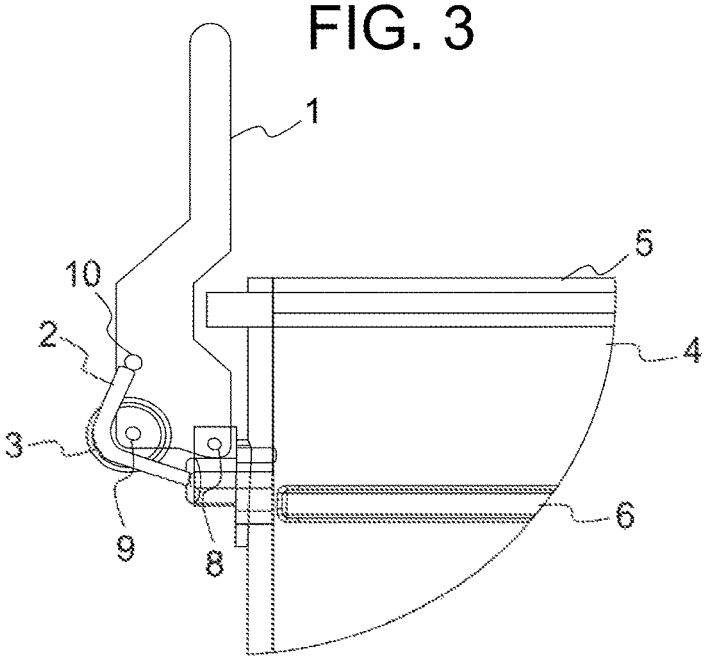
Figure 5:
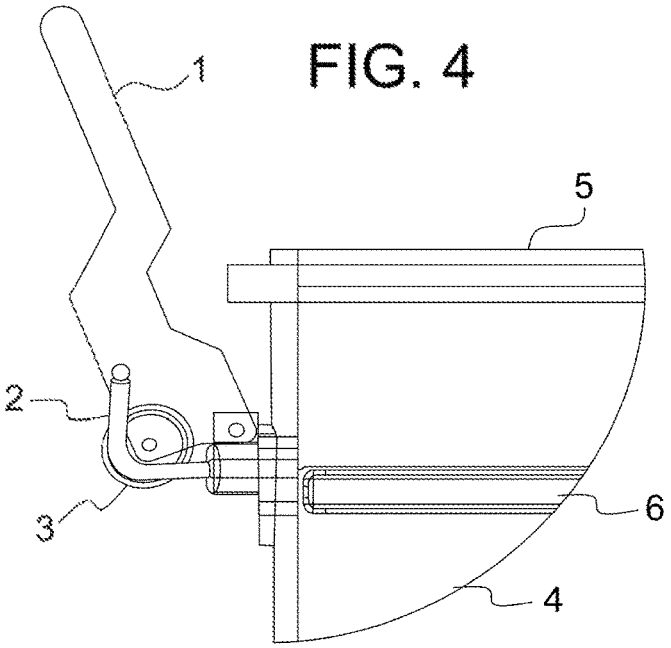
Figure 6:
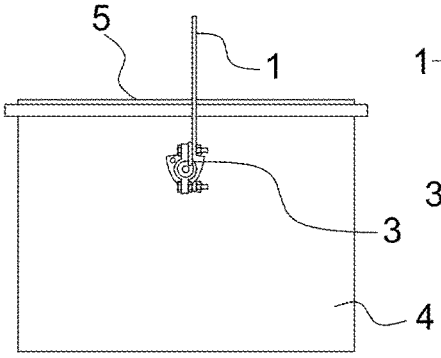
Figure 7:
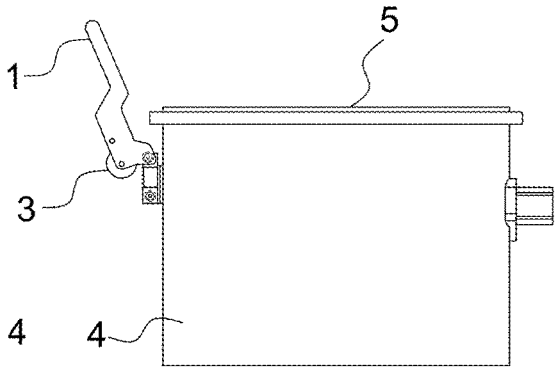
Figure 8:
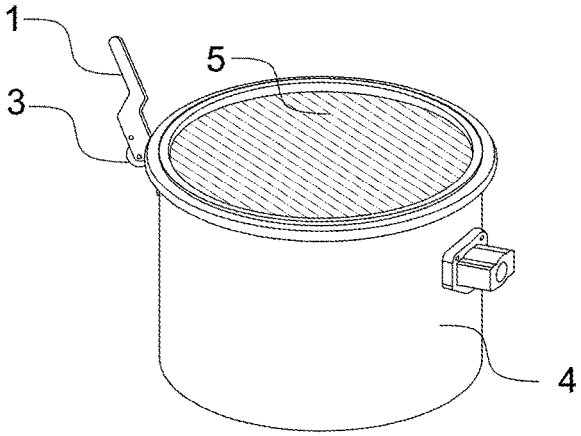
Figure 9:
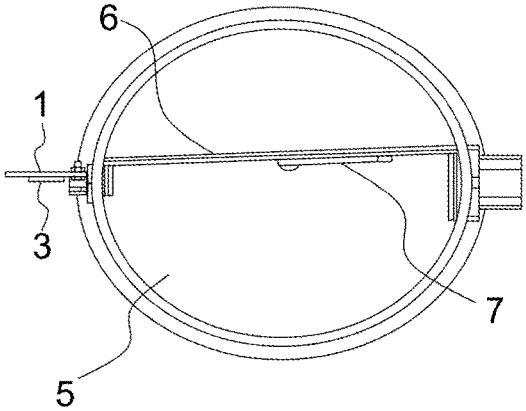

FIG. 4 shows a hinge point (8), a roller attachment (9), and a string tie point (10).

What is claimed is:

1. A drum and pitch adjustment device for a drum comprising:

a drum with a sound producing membrane, said drum having a drum shell and said sound producing membrane extending across a top side of said drum shell;

a pressure device for applying pressure to the sound producing membrane, wherein said pressure device is defined by a hinged post located inside of said drum shell and said pressure device is centrally disposed in a central portion of an interior of said drum shell adjacent to said sound producing membrane; and a cable configured to the device for applying and releasing pressure to the sound producing membrane, changing the pitch of the drum, but goes back to the drum's original pitch when absent this force, wherein said cable extends from said pressure device through said drum shell and to an exterior of said drum shell for being hand operated by a drummer to pull said pressure device and cause said pressure device to apply pressure to the sound producing membrane, and wherein releasing said cable releases said pressure device from pressing against said sound producing membrane.

2. The drum and pitch adjustment device as described in claim 1, further comprising:

a hand operated lever, located on the side of the drum exteriorly of said drum shell, wherein said hand operated lever is pivotally mounted to said drum shell at a hinge point and connected to said cable for operating to pull said cable which makes said pressure device push up against the sound producing membrane and changing its pitch, and wherein when absent this force, the drum goes back to its original pitch, which creates different tonal variety when played in real-time.

3. The drum and pitch adjustment device as described in claim 1, further comprising a roller attachment mounted to said lever, wherein said cable exits said drum shell and extends around said roller attachment and to a tie point at which said cable is secured to said lever, wherein said tie point is disposed adjacent to said roller attachment.

4. The drum and pitch adjustment device as described in claim 2, further comprising a support which extends through a central portion of said drum shell, from one side of said drum shell to an opposite side of said drum shell, and said pressure device is pivotally mounted to said support for pulling with said cable to engage said pressure device against said sound producing membrane.

5. The drum and pitch adjustment device as described in claim 4, wherein said pressure device comprises said hinged post having a protuberant member extending therefrom, said protuberant member having a head which is pressed against said sound producing membrane when said pressure device is pulled by said cable.

6. The drum and pitch adjustment device as described in claim 5, wherein said head of said protuberant member is of an arcuately protruding circular shape, with said circular shape being disposed in a plane substantially parallel to a planar surface of said sound producing membrane and said arcuately protruding circular shape extending upward from said plane and into said planar surface of said sound producing membrane when pressed into said sound producing membrane by said cable being pulled.

7. A drum and pitch adjustment device for a drum comprising:

a drum with a sound producing membrane, said drum having a drum shell and said sound producing membrane extending across top side of said drum shell;

a pressure device for applying pressure to the sound producing membrane, wherein said pressure device is defined by a hinged post located inside of said drum shell and said pressure device is centrally disposed in a central portion of an interior of said drum shell adjacent to said sound producing membrane;

a cable configured to the device for applying and releasing pressure to the sound producing membrane, changing the pitch of the drum, but goes back to the drum's original pitch when absent this force, wherein said cable extends from said pressure device through said drum shell and to an exterior of said drum shell for being hand operated by a drummer to pull said pressure device and cause said pressure device to apply pressure to the sound producing membrane, and wherein releasing said cable releases said pressure device from pressing against said sound producing membrane;

a hand operated lever, located on the side of the drum exteriorly of said drum shell, wherein said hand operated lever is pivotally mounted to said drum shell at a hinge point and connected to said cable for pushing to pull said cable which makes said pressure device push up against the sound producing membrane and changing its pitch, and wherein when absent this force, the drum goes back to its original pitch, which creates different tonal variety when played in real-time;

a roller attachment mounted to said lever, wherein said cable exits said drum shell and extends around said roller attachment and to a tie point at which said cable is secured to said lever, wherein said tie point is disposed adjacent to said roller attachment; and a support which extends through a central portion of said drum shell, from one side of said drum shell to an opposite side of said drum shell, and said pressure device is pivotally mounted to said support for pulling with said cable to engage said pressure device against said sound producing membrane.

8. The drum and pitch adjustment device as described in claim 7, wherein said pressure device comprises said hinged post having a protuberant member extending therefrom, said protuberant member having a head which is pressed against said sound producing membrane when said pressure device is pulled by said cable.

9. The drum and pitch adjustment device as described in claim 7, wherein said head of said protuberant member is of an arcuately protruding circular shape, with said circular shape being disposed in a plane substantially parallel to a planar surface of said sound producing membrane and said arcuately protruding circular shape extending upward from said plane and into said planar surface of said sound producing membrane when pressed into said sound producing membrane by said cable being pulled.

10. A drum and pitch adjustment device for a drum comprising:

a drum with a sound producing membrane, said drum having a drum shell and said sound producing membrane extending across top side of said drum shell;

a pressure device for applying pressure to the sound producing membrane, wherein said pressure device is defined by a hinged post located inside of said drum shell and said pressure device is centrally disposed in a central portion of an interior of said drum shell adjacent to said sound producing membrane;

a cable configured to the device for applying and releasing pressure to the sound producing membrane, changing the pitch of the drum, but goes back to the drum's original pitch when absent this force, wherein said cable extends from said pressure device through said drum shell and to an exterior of said drum shell for being hand operated by a drummer to pull said pressure device and cause said pressure device to apply pressure to the sound producing membrane, and wherein releasing said cable releases said pressure device from pressing against said sound producing membrane;

a hand operated lever, located on the side of the drum exteriorly of said drum shell, wherein said hand operated lever is pivotally mounted to said drum shell at a hinge point and connected to said cable for pushing to pull said cable which makes said pressure device push up against the sound producing membrane and changing its pitch, and wherein when absent this force, the drum goes back to its original pitch, which creates different tonal variety when played in real-time;

a roller attachment mounted to said lever, wherein said cable exits said drum shell and extends around said roller attachment and to a tie point at which said cable is secured to said lever, wherein said tie point is disposed adjacent to said roller attachment;

a support which extends through a central portion of said drum shell, from one side of said drum shell to an opposite side of said drum shell, and said pressure device is pivotally mounted to said support for pulling with said cable to engage said pressure device against said sound producing membrane;

wherein said pressure device comprises said hinged post having a protuberant member extending therefrom, said protuberant member having a head which is pressed against said sound producing membrane when said pressure device is pulled by said cable; and wherein said head of said protuberant member is of an arcuately protruding circular shape, with said circular shape being disposed in a plane substantially parallel to a planar surface of said sound producing membrane and said arcuately protruding circular shape extending upward from said plane and into said planar surface of said sound producing membrane when pressed into said sound producing membrane by said cable being pulled.

* * * * *